United States Patent [19]

Cureton et al.

[11] Patent Number: 4,702,070

[45] Date of Patent: Oct. 27, 1987

[54] GAS TURBINE ENGINE VALVE CONTROL SYSTEM

[75] Inventors: John E. Cureton, Coventry; Michael R. Lyons, Leicester, both of England

[73] Assignee: Rolls-Royce plc, London, England

[21] Appl. No.: 823,756

[22] Filed: Jan. 29, 1986

[30] Foreign Application Priority Data

Mar. 5, 1985 [GB] United Kingdom ..... 8505605

[51] Int. Cl.[4] ..... F02C 7/00

[52] U.S. Cl. ..... 60/39.07; 60/39.29

[58] Field of Search ..... 60/39.07, 39.27, 39.29; 415/27, 28

[56] References Cited

U.S. PATENT DOCUMENTS 2,732,125 1/1956 Ruby ..... 60/39.29
2,837,269 6/1958 Torell ..... 60/39.29
2,863,601 12/1958 Torell ..... 60/39.29
2,969,805 11/1961 Hunter ..... 415/27
3,006,145 10/1961 Sobey ..... 60/39.29

*Primary Examiner*—Louis J. Casaregola
*Attorney, Agent, or Firm*—Cushman, Darby & Cushman

[57] ABSTRACT

A control apparatus for the bleed valve of a gas turbine engine compressor enables the engine to be operated with a low risk of compressor surge or stall, particularly on emergency shut down.

The control apparatus includes a control valve and a diverter valve. In normal operation the bleed valve is controlled by the control valve which receives a flow of high pressure air from the engine compressor. In an emergency shut down, the diverter valve is operated to allow the high pressure air to flow directly to the bleed valve, without passing through the control valve.

The diverter valve can be fuel pressure responsive or solenoid operated.

5 Claims, 4 Drawing Figures

30
14
56
28
65
66
60
64
58
62
68

80
86
82
84
90
88
54
90
88
34
44
46
42
56a
50
40
45a
38
32
45
48
AIR

GAS TURBINE ENGINE VALVE CONTROL SYSTEM

This invention relates to a valve control system. In particular it relates to a control system for a bleed valve of a gas turbine engine compressor.

The bleed valve is provided to control compressor air flow at low engine speeds and enables the compressor to operate efficiently over a wide speed range, whilst minimising the risk of compressor surge and stall. Additionally, the compressor may have a row or rows of variable angle intake guide vanes, the angle of which is varied automatically to minimise the stalling of the front stage or stages of the rotor blades. It is sometimes necessary in both aero and stationary gas turbines to reduce the power of the engine at high rates. For example, in the case of a gas turbine engine arranged to generate electricity by driving a generator through a free power turbine, if the power turbine over speeds, the gas turbine must be shut down as soon as possible to prevent damage to the power turbine. At the high rates of deceleration which such an operation involves , the bleed valve of the gas turbine engine compressor must be opened very quickly, otherwise the compressor will surge and the engine may be damaged.

The present invention seeks to provide a compressor having a bleed valve, and a bleed valve control which enables the bleed valve to be opened at low engine speeds and very high rates on shut down.

Accordingly, the present invention comprises a gas turbine engine compressor having a bleed valve and bleed valve control means, the bleed valve control means having a control valve and a diverter valve the control valve having an operating means and adapted to receive a flow of pressurised air from the compressor, an outlet for the pressurised air connected to the bleed via the diverter valve and an outlet for the pressurised air vented to atmosphere, the diverter valve having an operating means, an inlet for a flow of pressurised air from the compressor, an inlet for a flow of pressurised air from the control valve and an outlet for the pressurised air connected to the bleed valve, the operating means of the control valve being operable by signal to either connect the air inlet to the bleed valve air outlet or to the vent, the operating means of the diverter valve being operable by signal to close the inlet receiving pressurised air from the control valve and to connect the diverter valve inlet receiving pressurised air from the compressor with the outlet connected to the bleed valve.

The diverter valve may comprise a housing and a valve body movable within the housing to allow pressurised air to flow directly through the diverter valve to the bleed valve or through the control valve and the diverter valve.

The diverter valve can comprise a shuttle valve having a differential area piston acted upon by fuel pressure and air pressure.

Alternatively, the diverter valve can comprise a solenoid operated valve.

The present invention will now be more particularly described with reference to the accompanying drawings in which FIG. 1 shows an elevation of a gas turbine engine incorporating the present invention.

Figure 1:
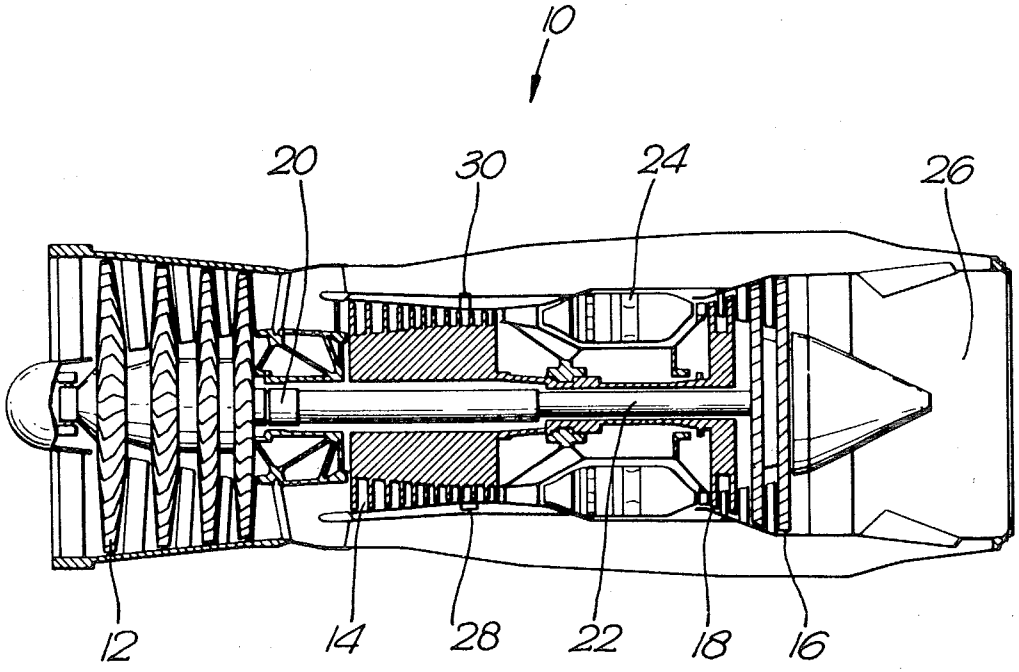

Referring to FIG. 1, a gas turbine engine 10 has low and high pressure compressors 12, 14 respectively, driven by low and high pressure turbines 16, 18 respectively through shafts 20, 22. A combustion apparatus 24 burns fuel with the air from the high pressure compressor and delivers the products of combustion to the turbines 16, 18. The propulsive gases leave the engine through a nozzle 26 and exhaust to atmosphere in the case of an aero-engine, or flows to a free power turbine (not shown) in the case of an industrial engine.

Figure 2:
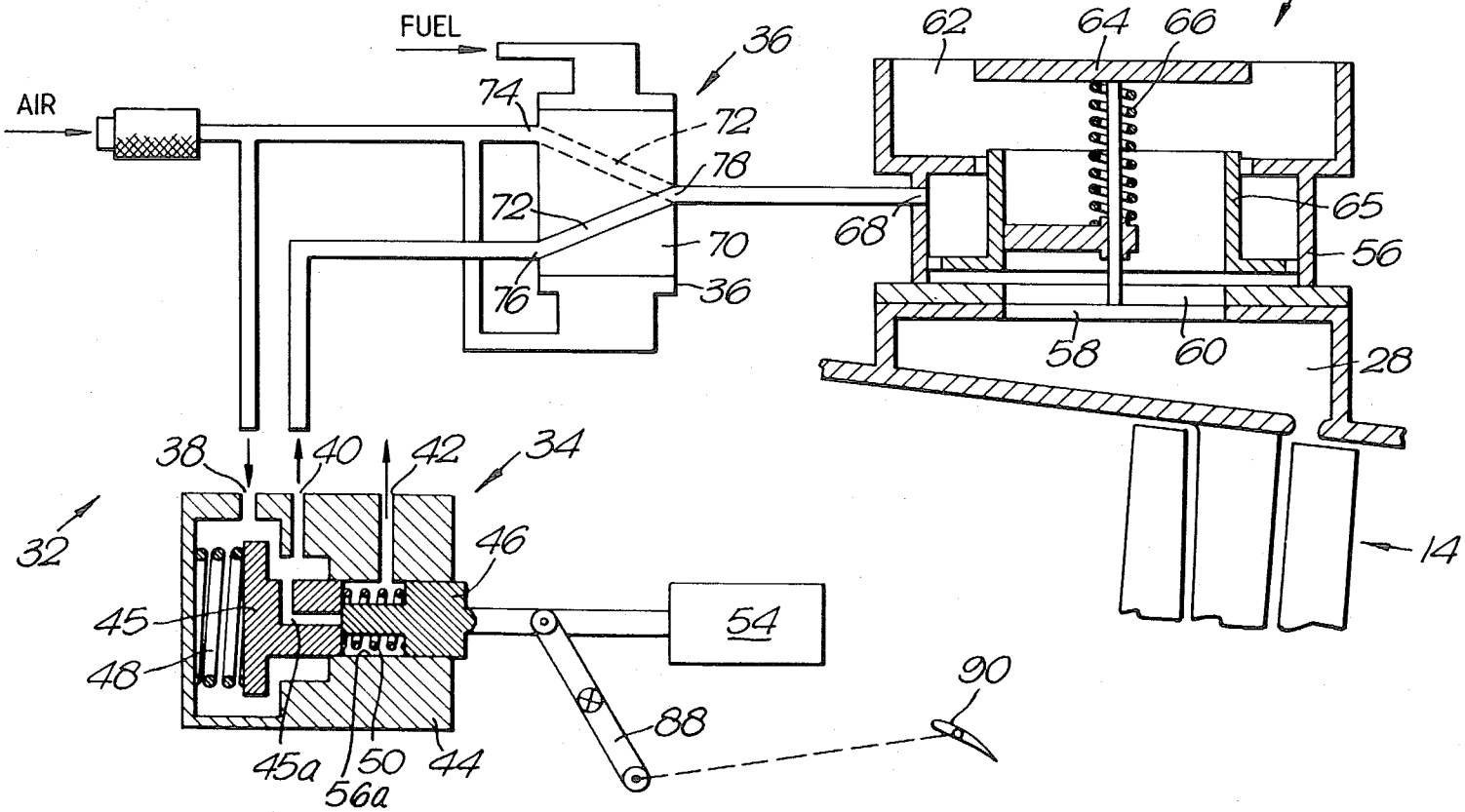
FIG. 2 shows a layout of a bleed valve and bleed valve control means which form part of the present invention.

The high pressure compressor has a manifold 28 and associated bleed valve 30, shown more clearly in FIG. 2. The operation of the bleed valve is controlled by a bleed valve control means 32, shown in FIG. 2 and in an alternative form in FIG. 3.

Referring to FIG. 2, the bleed valve control means 32 comprises a control valve 34, a diverter valve 36. The control valve 34 has an air inlet 38 arranged to receive a flow of high pressure air from the high pressure compressor 14, an air outlet 40 connected to the bleed valve 30, via the diverter valve 36, and a vent 42 to atmosphere.

The control valve 34 includes a housing 44 incorporating the inlet 38, and outlets 40, 42 and a twopart valve body 45, 46 movable in the housing. The two parts of the valve body are urged together by a compression spring 48, and are biased apart by a further compression spring 50, and the part 44 of the valve body has an internal passageway 56. The control valve is actuated by a hydraulic ram 54 the displacement of which depends upon the delivery pressure of compressor 14, and thus engine speed.

The bleed valve 30 comprises a housing 56 attached to the manifold 28 over an opening 58 in the manifold. The housing has an inlet 60 aligned with the opening 58, and an annular outlet 62 defined by the wall of the housing 56 and a central plate 64. A cylindrical sleeve-like valve body 65 is movable in the housing and is biassed to the open position, as shown in FIG. 2 by a compressor spring 66. The housing has an inlet port 68 connected to the outlet port 40 of the control valve 34 via the valve 36.

Figure 4:
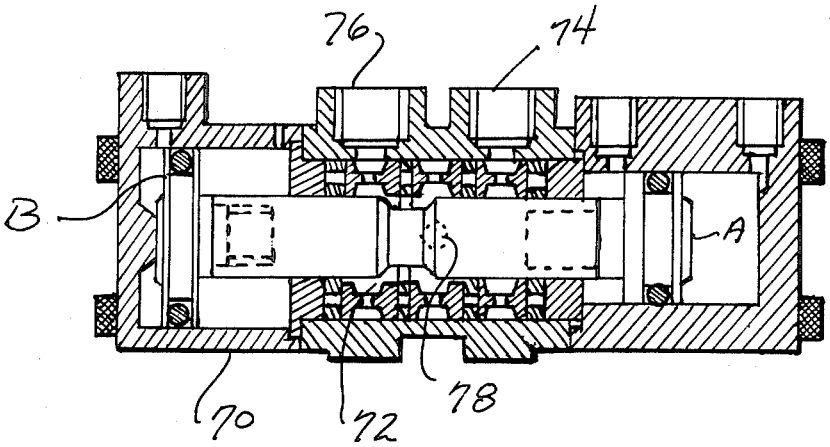
FIG. 4 is a sectional view in elevation of a portion of the diverter valve arrangement of the present invention.

The diverter valve 36 is a fuel pressure activated shuttle valve. The valve 36 has a valve body 70 with an internal passage 72. The ends of the valve body are arranged to be subjected to a fuel flow taken from an engine fuel system at the required pressure and an air pressure from the high pressure compressor 14. The valve body is a differential area piston arranged so that the area acted upon by the air pressure is greater than the area acted upon by the fuel pressure. One example of a valve structure useful as the valve 70 is shown in FIG. 4. In FIG. 4, the area acted upon by the air pressure is designated by the letter A and the area acted on by the fuel pressure is indicated by B.

The valve 36 has an inlet 74 arranged to receive the high pressure air directly from the compressor 16, and an inlet 76 arranged to receive the high pressure air through the control valve 34. An outlet 78 connects the diverter valve 36 to the bleed valve 30. The movement of the valve body enables one or other of the inlets 74, 76 to be connected to the outlet 78 via the passage 72.

In FIG. 2, the combined effect of the fuel and air pressures on the valve body 70, places the inlet port 76 in communication with the outlet port 78 enabling the high pressure air from the compressor to flow to the bleed valve through the control valve 34 and the diverter valve 36.

In FIG. 2, the ram 54 has moved the valve body to the left against the load exerted by the compression springs 48, 50. The inlet port 38 is then put in communication with the exhaust port 40, allowing the high pressure air from the compressor to flow to the bleed valve 30 through the valve 36 as described. The high pressure air acts on the rim of the valve body 65 opening the valve at a slow response rate and allowing compressor air to pass to atmosphere via a by-pass duct through the openings 58, 60 and 62.

The bleed valve is usually opened at engine start-up and remains fully open until a pre-determined engine speed is reached when the valve is closed at a slow response rate. Bleed valve closure is achieved by moving the ram, allowing the valve body part 45 to move to the right under the influence of the spring 48 and the two parts of the valve body to be forced apart by the spring 50. This operation closes off the inlet 38 from the outlet 40, and places the two outlets 40, 42 in communication with one another. The effect of the operation is to isolate the supply of high pressure air to the control valve and to vent the bleed valve inlet to atmosphere. The bleed valve then closes under the influence of the pressure in the compressor against the load exerted by the springs.

In an emergency shut down situation, the fuel pressure decreases very rapidly below the value of the air pressure acting on the valve body 70. The air pressure acting on a larger area of the piston moves the valve body to close the inlet 76 and places the inlet port 74 directly in communication with the outlet 78. High pressure air is then supplied to the bleed 30 to open the valve very quickly and prevents compressor surge.

While the bleed valve control system described above is suitable for engines operating on liquid fuels, industrial gas turbines frequently have to be capable of operating on gas fuels as well.

Figure 3:
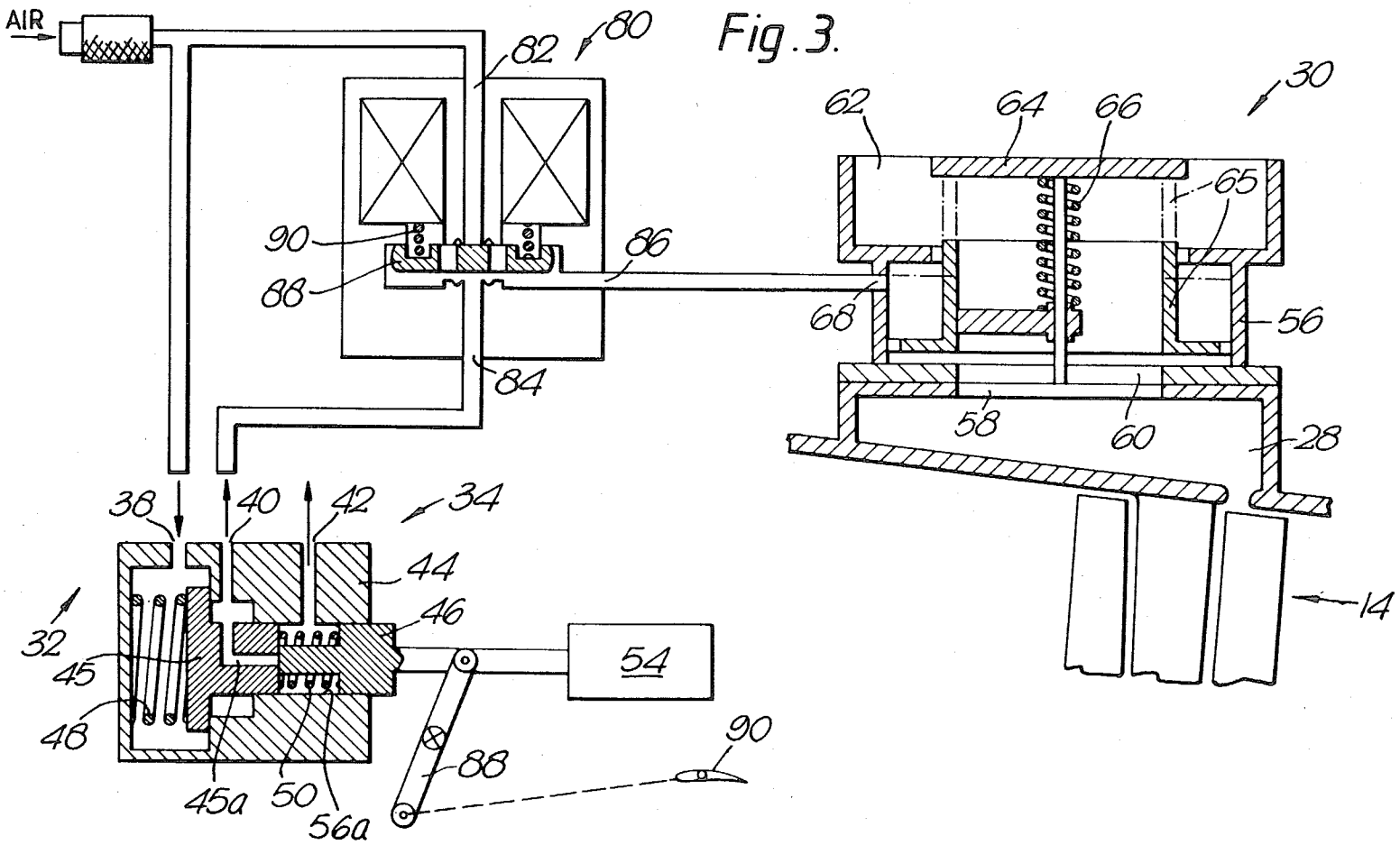
FIG. 3 shows an alternative form of the bleed valve control means to that shown in FIG. 2.

FIG. 3 shows a bleed valve control system 32 similar to that shown in FIG. 2, but incorporating a diverter valve 80 which operates independently of fuel pressure. The construction and operation of the control valve 34 and bleed valve 30 are the same as described with reference to FIG. 2. It shuld be noted that in FIG. 3, the ram 54 is in the position which closes off the valve to the inlet of high pressure air, and places the ports 40 and 42 communication. The bleed valve 65 is in the closed position (chain line) under the influence of pressure inside the compressor 14.

The diverter valve 80 is a solenoid operated valve having two inlet ports 82, 84 for the supply of high pressure air from the compressor 14. The inlet port 82 is a direct tapping from the compressor and the inlet port 84 receives the air through the control valve 34.

An outlet port 86 connects the diverter valve to the bleed valve. An apertured plate 88 is loaded by a spring 90 and enables the high pressure air tapped from the compressor to be supplied to the bleed valve either through the diverter valve and the control valve or directly through the diverter valve.

In normal engine operation, the solenoid is energised and the plate 88 closes off an internal passageway in the valve, preventing flow through the inlet port 82. The control valve controls the operation of the bleed valve.

In an emergency shut down, the solenoid is de-energised and the plate 88 urged by the spring 90 closes off the inlet port 84, and the high pressure compressor air flows through the inlet port 82, and the outlet port 86, directly to the bleed valve 30. The bleed valve opens very rapidly preventing engine surge.

It has been found that with the bleed valve control systems as described above, the bleed valve is fully open within approximately 0.5 seconds of the initiation of the shut down procedure.

As shown diagramatically in FIGS. 2 and 3 the hydraulic ram 54 is connected by a lever mechanism 88 to a row of variable inlet guide vanes 90. This arrangement enables the operation of the bleed valve 30 and the movement of the vanes 120 to be conveniently coordinated.

In some engine arrangements, without the benefit of the present invention as well as the bleed valve 30, solenoid operated blow off valves (not shown) on the low pressure compressor 12 may have to be provided to prevent or minimise the risk of compressor surge on shut down, whether as an emergency or as a normal shut down. It may also be necessary to schedule the bleed valve to be opened at an engine speed which reduces the effective engine operating range, but which is necessary to prevent compressor surge or stall.

The device of the present invention provides a control means for the bleed valve which allows the engine to be started and shut down normally or at a high rate with a very low or zero risk of compressor surge or stall occurring without reducing the effective efficient operating range. It may also be possible, depending upon the engine design and operational requirements to delete the blow off valves from the low pressure compressor.

The deletion of the blow-off valves represents a considerable cost saving and a reduction in the complexity of the engine handling system.

A further advantage of deleting the blow off valve is that the possibility of corrosive elements of fire extinguishant entering the engine is eliminated as unlike other engine bleeds and vents which are ducted overboard, the blow off valves exhaust into a module enclosing the engine.

We claim:

1. A gas turbine engine compressor having a bleed valve and bleed valve control means, the bleed valve control means having a control valve and a diverter valve, the control valve having an operating means and, said bleed valve control means including means for receiving a flow of pressurised air from the compressor, an outlet for the pressurised air connected to the bleed valve via the diverter valve, and an outlet for the pressurised air vented to atmosphere, the diverter valve having an operating means, an inlet for a flow of pressurised air from the compressor, an inlet for a flow of pressurised air from the control valve and an outlet for the pressurised air connected to the bleed valve, the operating means of the control valve being operable to either connect the air inlet to the bleed valve air outlet or to the vent, the operating means of the diverter valve being operable to close the inlet receiving pressurised air from the control valve and to connect the diverter valve inlet receiving pressurised air from the compressor with the outlet connected to the bleed valve.

2. A compressor as claimed in claim 1 in which the diverter valve comprises a housing and a valve body movable within the housing to allow pressurised air to flow directly through the diverter valve to the bleed valve or through the control valve and the diverter valve.

3. A compressor as claimed in claim 1 in which the diverter valve is a shuttle valve having a valve body comprising a piston, the compressor having means for exposing one area of said piston to engine fuel pressure and another area opposite said one area to pressurised air from the engine compressor, the area of the piston acted upon by the pressurised air being greater than the area of the piston acted upon by the fuel.

4. A compressor as claimed in claim 2 in which the diverter valve is a solenoid operated valve and the valve body comprises an apertured plate. air from the control valve and allows pressurised air to flow from the control valve and allows pressurised air to.

5. A compressor as claimed in claim 1 in which the bleed valve comprises a housing and a valve body and means for exposing a portion of said valve body to pressurised air from one of the control valve and the diverter valve, the valve body being movable by a flow of the pressurised air from the control valve or the diverter valve to open the bleed valve and allow compressed air within the compressor to be vented.

* * * * *